US007479017B1

(12) United States Patent
Koopman et al.

(10) Patent No.: US 7,479,017 B1
(45) Date of Patent: Jan. 20, 2009

(54) RIGHT ANGLE ELECTRICAL CONNECTOR

(75) Inventors: Steve Koopman, Floyds Knobs, IN (US); Jeremy Wooldridge, Shepherdsville, KY (US); Doug McCartin, Henryville, IN (US); Everett Koopman, Floyds Knobs, IN (US)

(73) Assignee: Samtec, Inc., New Albany, IN (US)

( * ) Notice: Subject to any disclaimer, the term of this patent is extended or adjusted under 35 U.S.C. 154(b) by 0 days.

(21) Appl. No.: 11/848,617

(22) Filed: Aug. 31, 2007

(51) Int. Cl.
*H01R 12/00* (2006.01)

(52) U.S. Cl. ..... 439/67

(58) Field of Classification Search ..... 439/67, 439/79, 492–499, 66; 361/684, 789
See application file for complete search history.

(56) References Cited

U.S. PATENT DOCUMENTS 5,501,612 A * 3/1996 Green ..... 439/499
5,944,554 A * 8/1999 Armand et al. ..... 439/499
6,537,082 B2 * 3/2003 Hopfer et al. ..... 439/67
6,652,318 B1 11/2003 Winings et al.
6,755,683 B2 * 6/2004 Roberts et al. ..... 439/496
2002/0177345 A1 * 11/2002 Daugherty et al. ..... 439/329
2006/0110951 A1 * 5/2006 Mongold ..... 439/67

* cited by examiner

*Primary Examiner*—Alexander Gilman
(74) *Attorney, Agent, or Firm*—Keating & Bennett, LLP

(57) ABSTRACT

A right angle electrical connector assembly includes a connector frame including a plurality of posts, each of the plurality of posts including at least one standoff rib extending therefrom, a flexible circuit having a first end portion and a second end portion, the second end portion being arranged to be connected to a circuit board. The flexible circuit includes a plurality of holes arranged to correspond to the plurality of posts, each of the plurality of posts is received in a respective one of the plurality of holes, and a height of a first major surface of the second end portion of the flexible circuit is set by the at least one standoff rib of each of the plurality of posts.

17 Claims, 10 Drawing Sheets

RIGHT ANGLE ELECTRICAL CONNECTOR

BACKGROUND OF THE INVENTION

1. Field of the Invention

The present invention relates to electrical connectors and more specifically, the present invention relates to a right angle electrical connector.

2. Description of the Related Art

Electrical connectors are used to place electrical devices, such as printed circuit boards, in communication with one another. An electrical connector may be thought of as having two portions, one portion of which connects to a first electrical device and the second portion of which connects to a second electrical device to be put into communication with the first device. To connect the two devices, the two portions of the electrical connector are mated together.

Each portion of the connector includes one set of contacts or terminals adapted to be communicatively coupled to an electronic device and a second set of contacts or terminals adapted to be communicatively coupled to the other connector portion. This can be readily accomplished by designating one portion of the connector as having "male" contacts or terminals adapted to be coupled to the other connector portion's "female" contacts or terminals. Regardless of the specific design of the contacts or terminals, the two connector portions should be adapted to be easily connected and disconnected from each other to respectively electrically link and unlink the electrical devices to which they are connected.

Accordingly, each connector portion is fixedly connected to an electronic device through its remaining set of contacts or terminals. The contacts or terminals may be removably or permanently connectable to the electrical device; however, it is usually desired that the connector portion be secured to the electrical device through some physical mechanism. Typically, the connector portions are secured to electrical devices by fusing the contacts or terminals to contact pads or the like formed on the electrical device.

Recently, there has been a trend toward miniaturization of most electrical devices. As electrical devices become smaller and more complex, the electrical connectors used with these devices must also become smaller and must be able to accommodate the more complex devices. One problem with miniaturized electrical connectors arises from the increased precision of placement necessary to produce the proper positioning and connection of the connector contacts or terminals onto the device. This problem is exacerbated by the ever-increasing input/output (I/O) density requirements demanded of the progressively smaller electrical connectors by increasingly miniaturized electrical devices. With increased pin counts (e.g., greater number of terminals) in each connector, it becomes more and more difficult to maintain desired levels of co-planarity while maintaining contact of all of the terminals to a substrate or PCB.

One method of addressing the need for increased I/O density is to provide an array connector. Such an array connector can provide a high-density two-dimensional array of contacts or terminals for interfacing with an electrical device. However, array connectors present attachment difficulties regarding connection to devices (i.e., circuit boards or substrates) since most of the contacts or terminals must necessarily be positioned in the interior of the two-dimensional array area and are accordingly difficult to align upon connection, visually inspect, and/or repair.

The use of a right angle connector, as shown in FIG. 10, is known. This type of right angle surface mount connector can be used for an array connector or a backplane connector. As is seen in FIG. 10, a PCB 600 must have a plurality of thru holes 610 formed therein to accommodate tails 652*a* of the contacts 652 of the right angle connector 650.

The tails 652*a* of the contacts 652 are typically compliant pins that provide electrical connections to the printed circuit board 600. The compliant pins 652*a* in right angle backplane connectors adversely affect signal integrity because they require the large diameter plated thru holes 610 to be formed in the printed circuit board. These large plated thru holes 610 require large anti pads to be placed in the ground planes of the printed circuit board, which also adversely affect the signal integrity.

As can be determined from FIG. 10 (and FIG. 1 of U.S. Pat. No. 6,652,318), when the right angle connector is assembled to the PCB, significant forces are required to insert the compliant pins 652 into the plated holes 610, and the other ends 652*b* of the contacts 652 must be attached to another PCB or electrical device as seen FIG. 1 of U.S. Pat. No. 6,652,318, which causes non-symmetric forces.

When the compliant pins 652*a* are inserted into the plated thru holes 610, many problems may occur. In many cases, non-symmetrical forces are applied when mating and unmating the right angle surface mount connector 650.

Another problem with the right angle connector shown in FIG. 10 is that the path lengths of the contacts 652 vary substantially from contact to contact. These different path lengths cause problems with skew. In the present application, "skew" means that signals which are sent at the same time arrive at the receiver at different times. In addition, the different path lengths may prevent uniform impedances for the contacts 652.

SUMMARY OF THE INVENTION

To overcome the problems described above, preferred embodiments of the present invention provide a right angle electrical connector including a flexible circuit that eliminates all of the above-described problems with conventional connectors.

According to a preferred embodiment of the present invention, an electrical connector assembly for providing an electrical connection to a circuit board includes a connector frame including a plurality of posts, each of the plurality of posts including at least one standoff rib extending therefrom, a flexible circuit having a first end portion and a second end portion, the second end portion being arranged to be connected to a circuit board. The flexible circuit includes a plurality of holes arranged to correspond to the plurality of posts, each of the plurality of posts are received in a respective one of the plurality of holes, and a height of a first major surface of the second end portion of the flexible circuit is set by the at least one standoff rib of each of the plurality of posts.

The connector assembly preferably further includes a stiffener attached to a second major surface of the second end portion of the flexible circuit. The height of the first major surface of the second end portion of the flexible circuit is set by engagement of the stiffener with the at least one standoff rib of each of the plurality of posts.

The connector assembly also preferably includes an array connector attached to the first major surface of the first end portion of the flexible circuit. The array connector is received in a recess of the connector frame.

The first end portion of the flexible circuit is preferably arranged in a plane that is substantially perpendicular to a plane in which the second end portion is arranged.

A stiffener is preferably provided on the second major surface of the first end portion of the flexible circuit.

The connector frame preferably includes at least one fastener arranged to attach the connector frame to the circuit board.

A plurality of fusible conductive elements are preferably disposed on the first major surface of the second end portion of the flexible circuit that are arranged to be connected to corresponding conductive pads on the circuit board.

In addition, the connector frame preferably includes at least one standoff disposed along an edge of the recess, each of the at least one standoff having a surface extending in a plane that is substantially parallel to a plane of the first major surface of the second end portion of the flexible circuit, and a height of the plurality of fusible conductive elements is set to be substantially flush with to about 0.003 inches below the surface of each of the at least one standoff.

The plurality of fusible conductive elements are preferably solder balls.

The connector frame preferably further includes at least alignment pin arranged to engage a corresponding alignment structure on the circuit board.

Preferably, the flexible circuit is a flexible printed circuit.

The electrical connector assembly is preferably a right angle connector assembly.

According to another preferred embodiment of the present invention, a method of assembling an electrical connector assembly includes the steps of providing a connector frame having a recess, a plurality of posts disposed in the recess, and at least one standoff rib extending from each of the plurality of posts, each of the plurality of posts having an distal end; providing a flexible circuit having first and second major surfaces, first and second end portions, and a plurality of holes disposed in the second end portion; arranging the second end portion of the flexible circuit on the connector frame such that each of the plurality of posts are received in a respective one of the plurality of holes, and a height of the first major surface of second end portion of the flexible member is set by the at least one standoff rib; and ultrasonic welding the plurality of posts and the at least one rib thereon so as to deform the distal end of each of the plurality of posts in order to fix the second end portion of the flexible circuit between the deformed distal end and the at least one rib. During the step of ultrasonic welding, the at least one rib is deform so as to adjust the height of the first major surface of the second end portion of the flexible member to a desired height.

Preferably, the method further includes the step of attaching a stiffener to the second major surface of the second end portion of the flexible circuit. In the step of arranging the second end portion flexible circuit, the stiffener is disposed between the second end portion of the flexible circuit and the at least one rib, and a major surface of the stiffener is in contact with the at least one rib.

Preferably, the method further includes the steps of providing another recess in the connector frame; providing a groove at each of opposed ends of the another recess; attaching an array connector to the first major surface of the first end portion of the flexible circuit, the array connector including a projection at each of opposed end portions thereof; and arranging the projections of the array connector in the grooves of the connector frame.

Preferably, the groove at one opposed end of the recess has a width that is different from a width of the groove at the other opposed end of the recess, the projection at one opposed end of the array connector has a width that corresponds to the groove at the one opposed end of the recess, and the projection at the other opposed end of the array connector has a width that corresponds to the groove at the other opposed end portion of the recess, such that the array connector can be arranged on the connector frame in only one orientation.

Preferably, the method further includes the steps of providing at least one standoff arranged along an edge of the recess of the connector frame, each of the at least one standoff having a surface extending in a plane that is substantially parallel to a plane of the first major surface of the second end portion of the flexible circuit; and providing a plurality of fusible conductive elements on the first major surface of the second end portion of the flexible circuit. During the step of ultrasonic welding, the height of the flexible circuit is set such that the fusible conductive elements are set to a height that is substantially flush with to about 0.003 inches below the surface of the at least one standoff extending in the plane that is substantially parallel to the plane of the first major surface of the end portion of the flexible circuit.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described with reference to FIGS. 1-9, which provide a completely different and totally new configuration for a right angle electrical connector.

Figure 1:
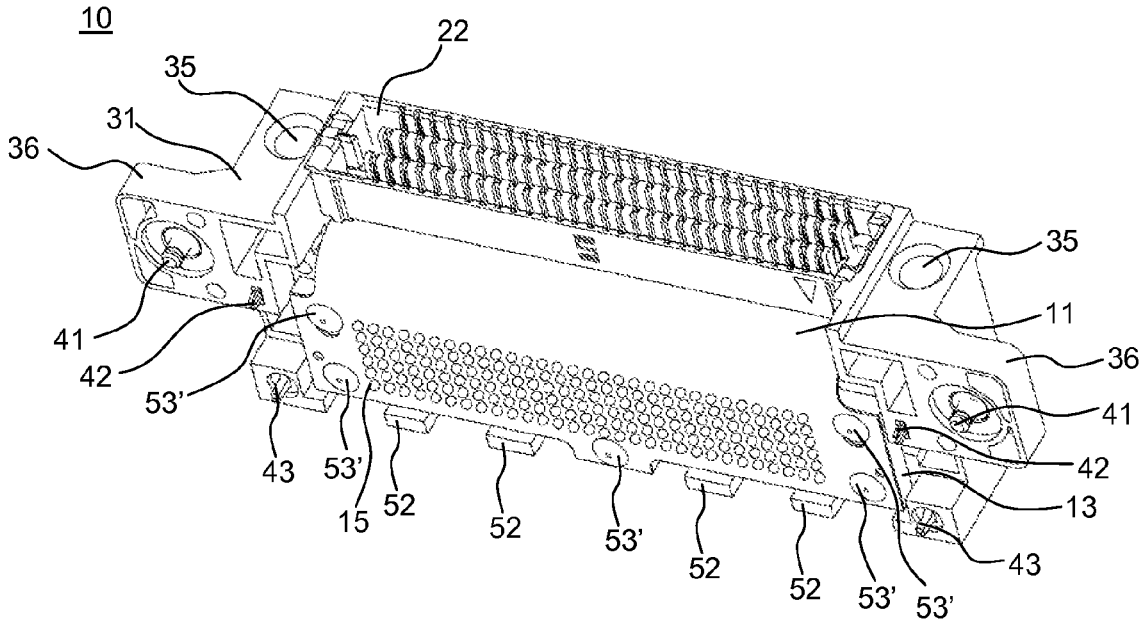
FIG. 1 is an isometric view of the connector assembly according to a preferred embodiment of the present invention.
Figure 2:
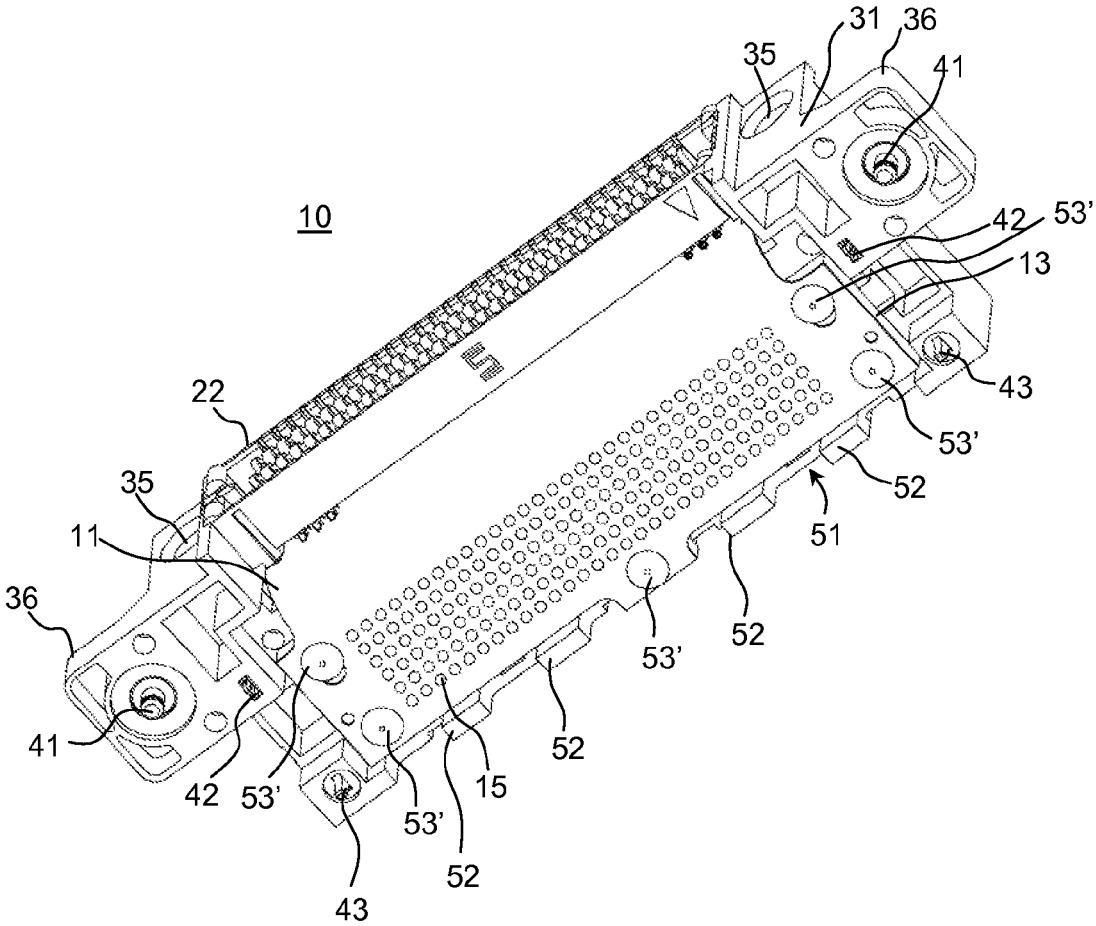
FIG. 2 is another isometric view of the connector assembly shown in FIG. 1.
Figure 3:
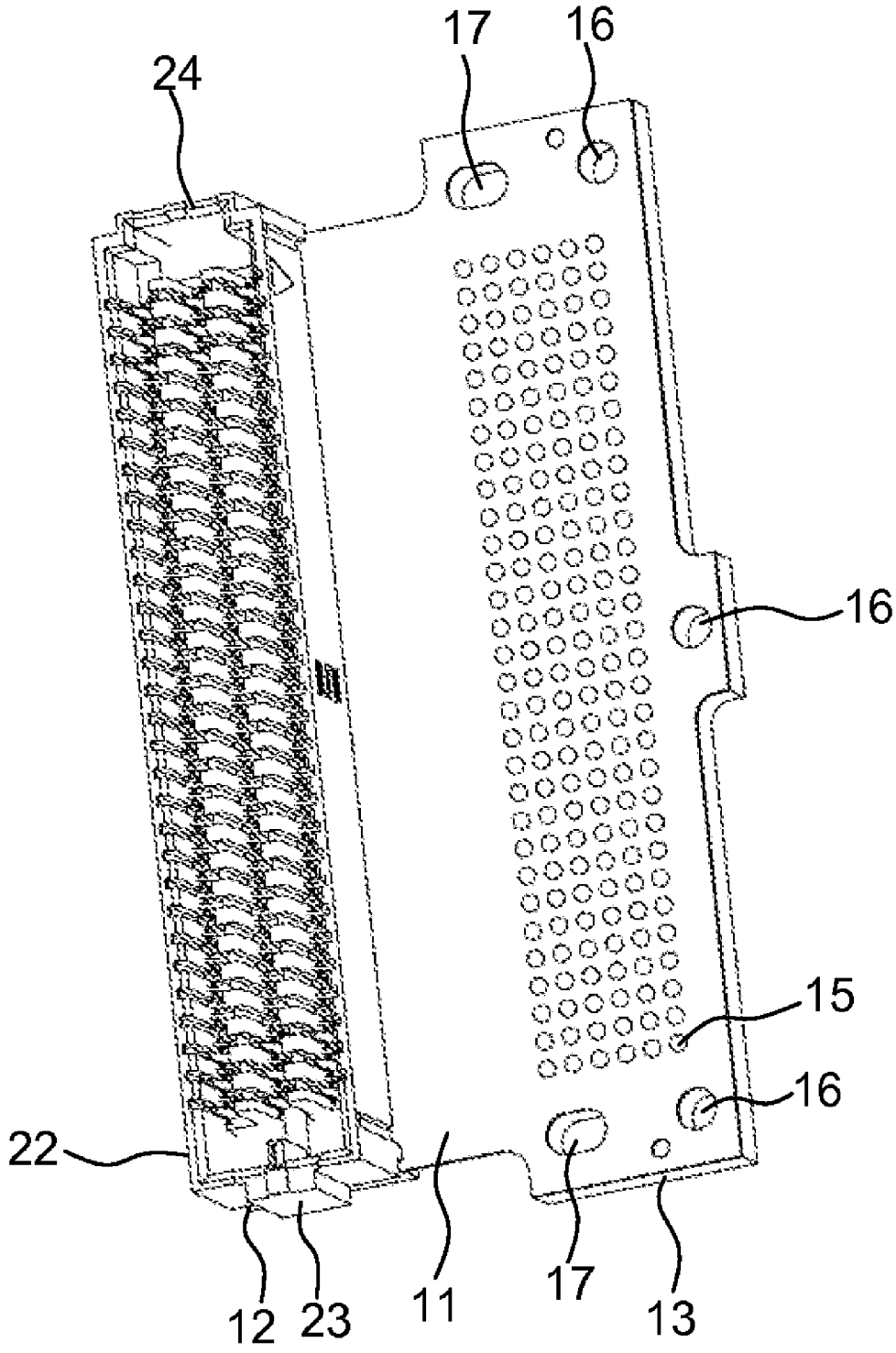
FIG. 3 is an isometric view of a sub-assembly of the connector assembly shown in FIG. 1.
Figure 4:
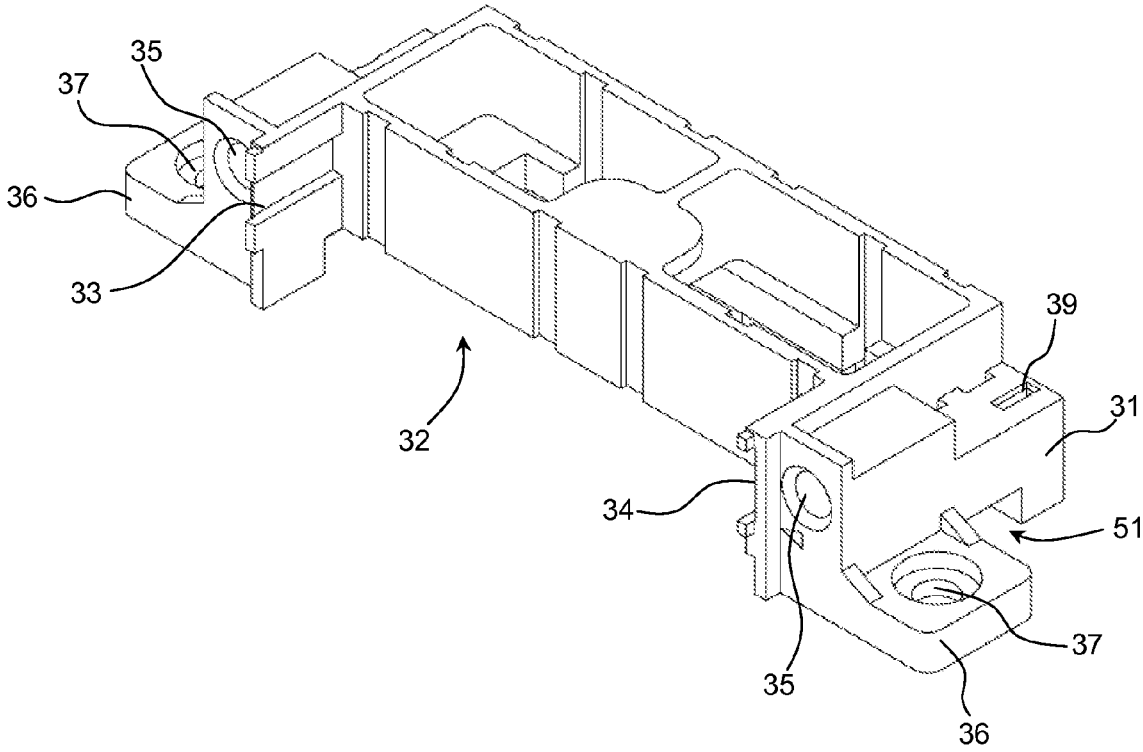
FIG. 4 is an isometric view of another sub-assembly of the connector assembly shown in FIG. 1.

FIGS. 1-8 show a connector assembly 10 according to a preferred embodiment of the present invention. FIGS. 1, 2, 7, and 8 show the connector assembly 10 in an assembled state, FIGS. 3 and 4 show sub-assemblies of the connector show in FIGS. 1 and 2, and FIGS. 5 and 6 shown the connector assembly 10 in partially assembled states.

As shown in FIG. 3, a connector sub-assembly of the connector assembly 10 preferably includes a flexible circuit 11 and an array connector 22 connected to the flexible circuit 11. A first end portion of the flexible circuit 11 is physically and electrically connected to the array connector 22 along a portion of a first surface of the flexible circuit 11. The first surface at the first end portion of the flexible circuit 11 and the first surface at a second end portion of the flexible circuit 11 include a plurality of fusible conductive elements 15, such as solder balls, solder crimps, solder preforms, solder charges, or other suitable fusible conductive elements, which are preferably made of a fusible conductive material and are used to electrical connect the first and second ends of the flexible circuit 11 to the array connector 22 and to a circuit board (not shown), respectively.

Preferably, the flexible circuit 11 is a flexible printed circuit including traces printed thereon. The traces provide electrical connection between each of the conductive fusible elements 15 disposed on the first major surface of the second end portion of the flexible circuit 11 and corresponding conductive pads disposed on the first major surface of the first end portion of the flexible circuit 11. Each of the traces has substantially the same path length.

A first stiffener 12 and a second stiffener 13 are attached to the first and second end portions of the flexible circuit 11 as best seen in FIG. 3. The stiffeners 12 and 13 are preferably attached to the flexible circuit 11 by adhesives or other suitable attachment methods. The stiffeners may be made of any suitable material, such as plastic, FR4, metal, or metal alloys.

Instead of the stiffeners 12 and 13 used in the present preferred embodiment, the flexible circuit 11 may be constructed so as to include integrally formed increased thickness portions at each of the first and second end portions in order to provide the required stiffness.

As shown in FIG. 4, a connector frame 31 includes a recess 32 for receiving the array connector 22 (shown in FIG. 3) therein. Grooves 33 and 34 are provided at opposed ends of the recess 32 for receiving projections 23 and 24 provided at respective ends of the array connector 22 (see FIG. 3). As shown in FIG. 4, the grooves 33 and 34 of the connector frame 31 have corresponding different widths and the projections 23 and 24 of the array connector 22, as shown in FIG. 3, have different widths such that the array connector 22 can be arranged in the recess 32 in only one orientation. Although the grooves 33 and 34 and the projections 23 and 24 are used in the present preferred embodiment, any suitable mating members, such as A-pins, may be used to ensure proper orientation of the array connector 22 with respect to the connector frame 31. It is noted that no structure is required to orient the connector frame 31 and the array connector 22.

Figure 5:
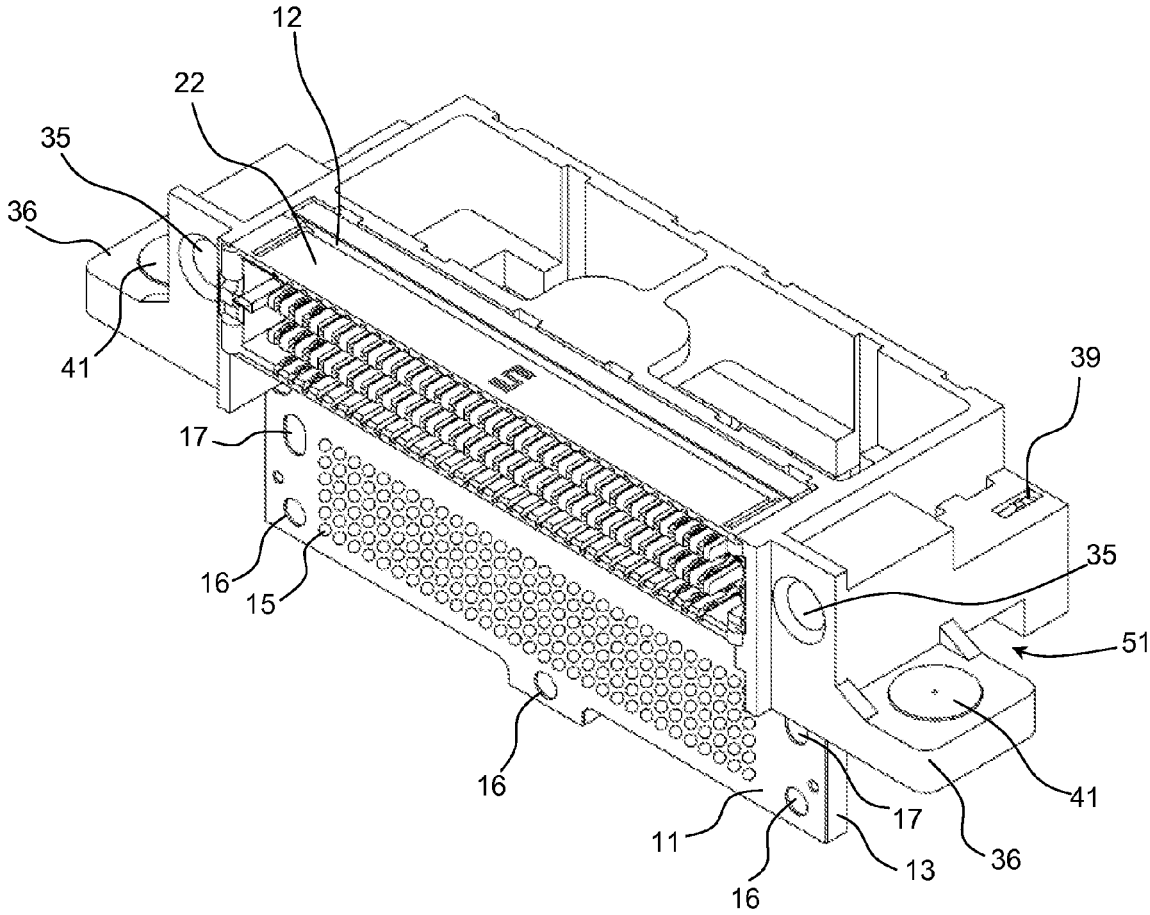
FIG. 5 is an isometric view of the connector assembly shown in FIG. 1 in a partially assembled state.

The connector frame 31 includes alignment holes 35 adjacent to the opposed ends of the recess 32 for engaging alignment posts (not shown) of a mating electrical connector. Instead of the alignment holes 35, the connector frame may be provided with alignment posts for engagement with alignment holes of a mating electrical connector. Alternatively, any other suitable arrangement of alignment structure may be used. Flanges 36 extend from opposed ends of the connector frame 31, and holes 37, as shown in FIG. 4, are provided in each of the flanges 36 for receiving a fastener 41, as shown in FIG. 5. The fastener 41 is provided to attach the connector frame 31 to a printed circuit board (not shown).

Figure 6:
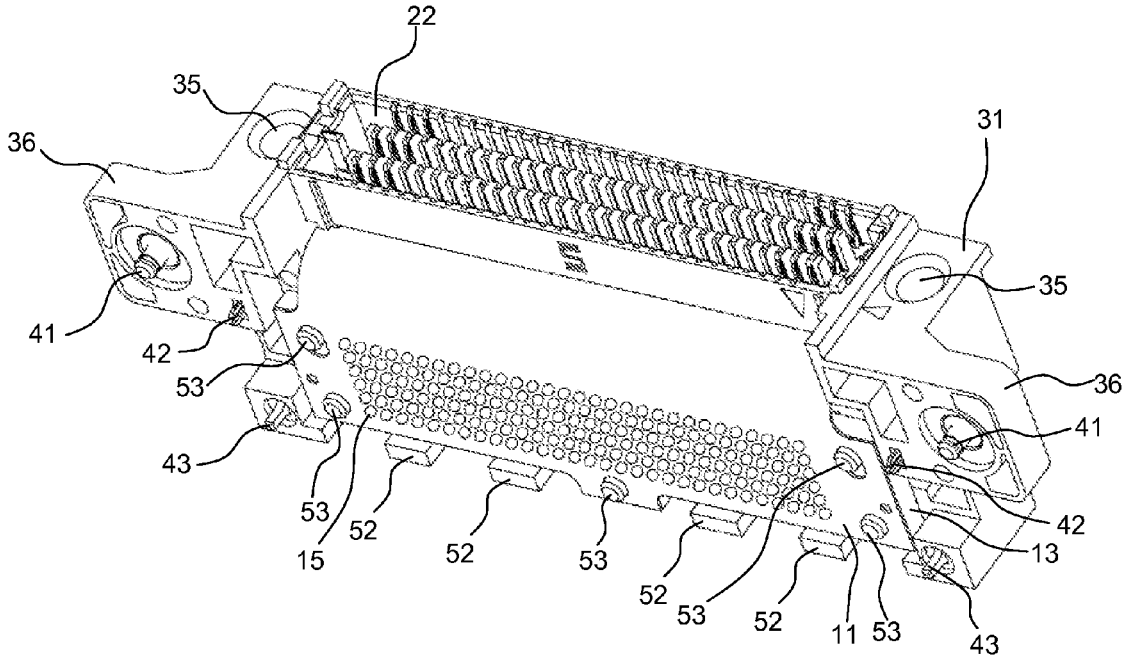
FIG. 6 is an isometric view of the connector assembly shown in FIG. 1 in another partially assembly state.
Figure 7:
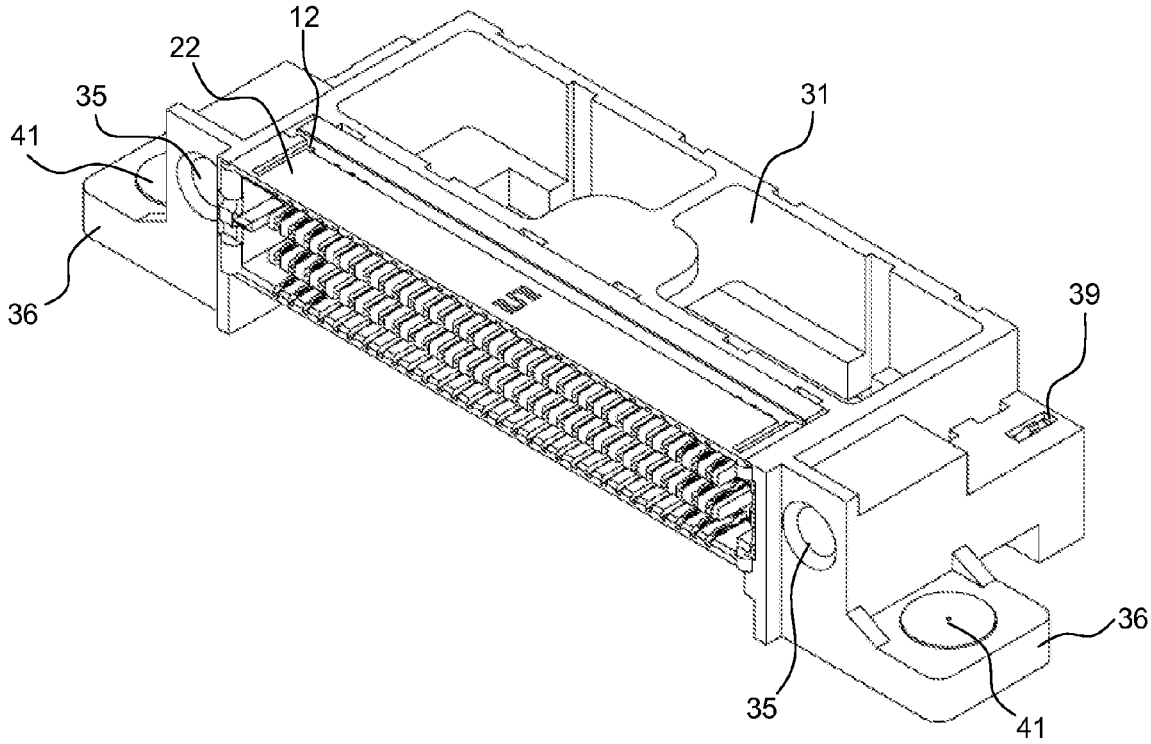
FIG. 7 is another isometric view of the connector assembly shown in FIG. 1.
Figure 8:
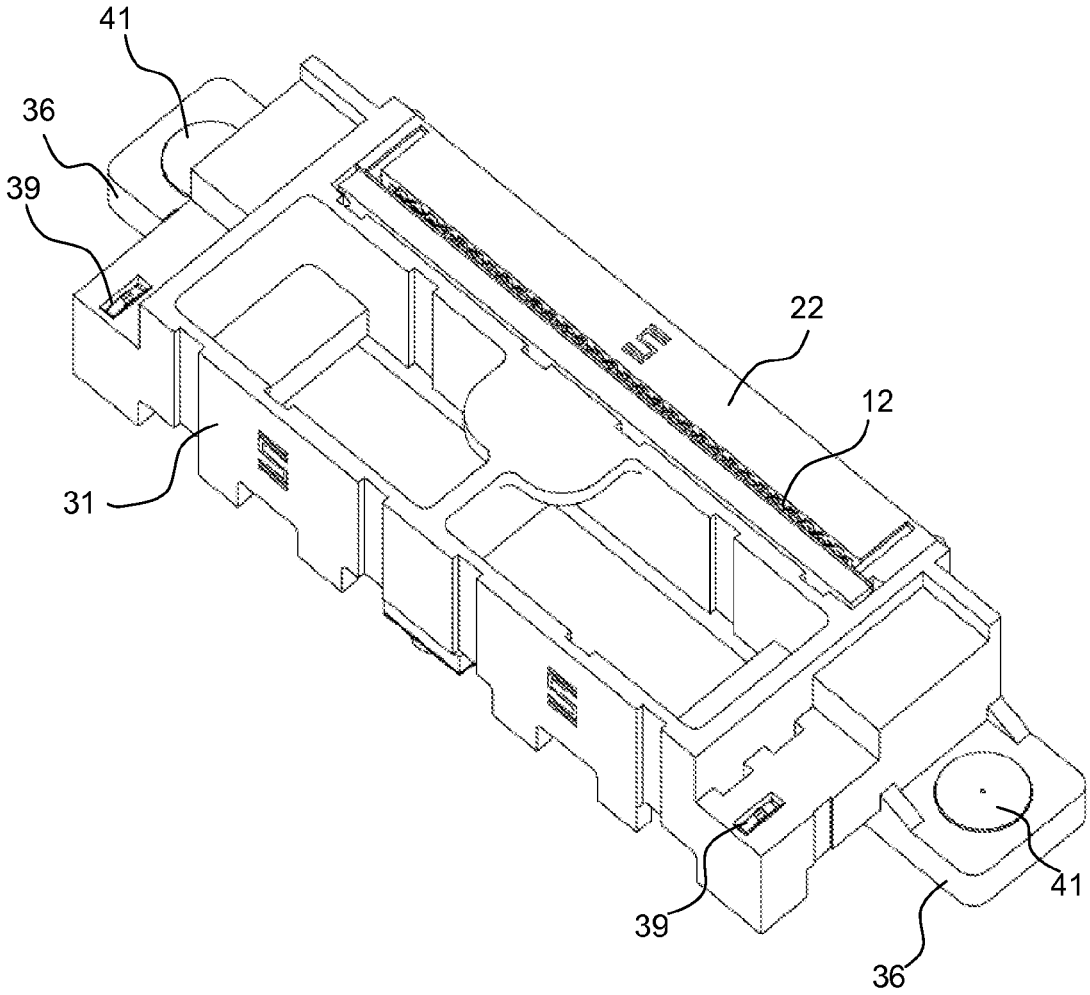
FIG. 8 is still another isometric view of the connector assembly shown in FIG. 1.

As shown in FIGS. 1, 2, and 6, the connector frame 31 also includes substantially rectangular holes 38 in which fasteners 42 are received, and substantially rectangular holes 39 in which alignment pins 43 are received. The fasteners 42 are arranged to engage with corresponding structures on a printed circuit board (not shown), and the alignment pins 43 are arranged to engage with alignment holes on the printed circuit board. Although the holes 38 and 39 are substantially rectangular in the present preferred embodiment, the holes 38 and 39 may have any suitable shape.

Any suitable type of fasteners, such as rivets, screws, snap fitting clips, etc., may be used for the fasteners 41 and 42, and any suitable type of alignment structure, such as alignment holes, alignment grooves, etc., may be used in place of the alignment pins 43.

Figure 9:
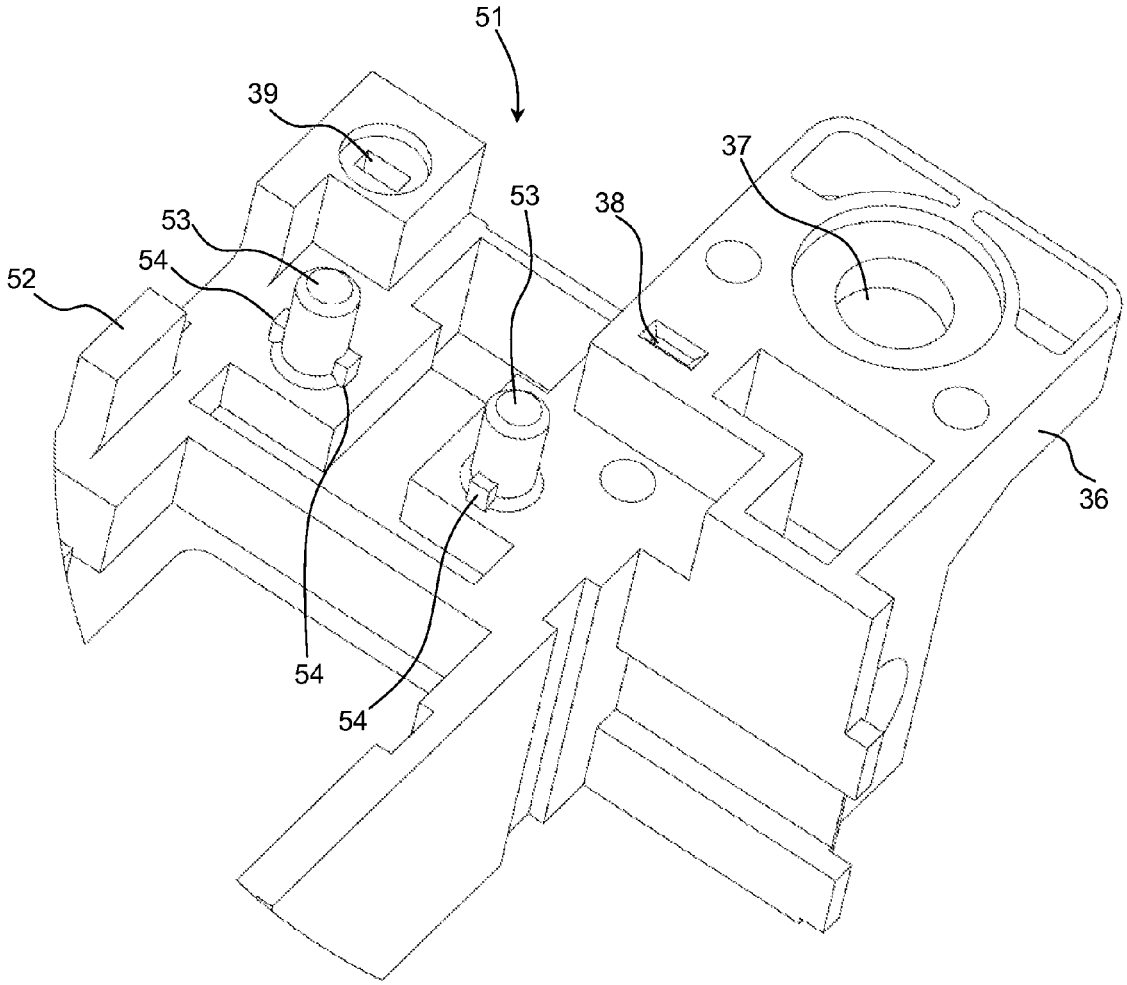
FIG. 9 is an isometric view of a portion of a sub-assembly of the connector assembly shown in FIG. 1.
Figure 10:
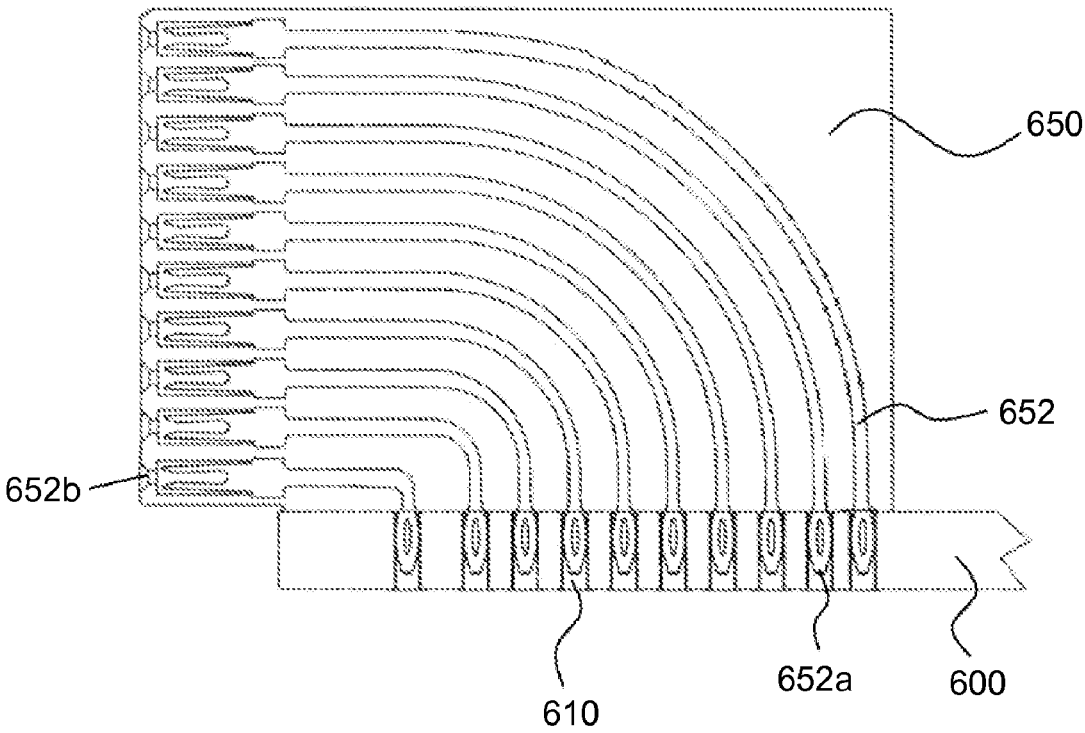
FIG.10 PRIOR ART
FIG. 10 is a view of a conventional right angle connector mated with a printed circuit board.

As best seen in FIG. 9, the connector frame 31 includes a recess 51 to receive the second end portion of the flexible circuit 11 and the attached stiffener 13 (shown in FIG. 3). Standoffs 52 are disposed along an edge of the recess 51. However, any suitable arrangement of standoffs may be used. A plurality of posts 53 are disposed in the recess 51 and extend further outward from the recess 51 than the standoffs 52. Each of the posts 53 includes standoff ribs 54 disposed around the periphery of the posts 53. However, other arrangements of posts and standoff ribs may be used.

Substantially circular holes 16 are provided at various locations around the periphery of the flexible circuit 11. In addition, elongated holes 17 are provided at various locations around the periphery of the flexible circuit 11. Each of the substantially circular holes 16 and the elongated holes 17 extends through the attached stiffener 13. The substantially circular holes 16 and the elongated holes 17 are arranged to be spaced from the portion of the flexible circuit 11 at which the fusible conductive elements 15 are disposed. The specific arrangement of the substantially circuit holes 16 and the elongated holes 17 is not specifically limited, and any suitable arrangement may used.

Each of the posts 53 is received in a respective one of the substantially circular holes 16 and the elongated holes 17 such that a surface of the stiffener 13 opposite to the surface of the stiffener 13 attached to the flexible circuit 11 is engaged with the standoff ribs 54 of the respective posts 53. The standoff ribs 54 prevent the stiffener 13 from contacting the bottom of the recess 51, and sets an initial height of the surface of the flexible circuit 11 on which the fusible conductive elements 15 are disposed.

In applications in which a large pin count is required, the flexible circuit 11 may be split into more than one individual piece on the end of the flexible circuit 11 that is connected to a circuit board. For example, if a particular application requires 500 input/outputs, the flexible circuit 11 may be split into two portions, such that 250 input/outputs are provided on each of the split portions of the flexible circuit 11. The splitting of the flexible circuit 11 is referred to as banking.

The process of assembling the connector assembly 10 will be described below with reference to FIGS. 1 and 3-6.

The flexible circuit 11 including the attached stiffeners 12 and 13 and the array connector 22 is shown in FIG. 3 prior to assembly. As shown in FIG. 5, the projections 23 and 24 of the array connector 22 are inserted into the recesses 33 and 34 (shown in FIG. 4) of the connector frame 31. During this step the flexible circuit 11 is maintained in a substantially planar arrangement.

As shown in FIG. 6, after the projections 23 and 24 of the array connector 22 are inserted into the recesses 33 and 34 (shown in FIG. 4) of the connector frame 31, the flexible circuit 11 is bent substantially 90 degrees from the orientation shown in FIG. 5, and the substantially circular holes 16 and the elongated holes 17 of the flexible circuit 11 engage with respective ones of the posts 53 such that the surface of the stiffener 13 opposite to the surface of the stiffener attached to the flexible circuit 11 is engaged with the standoff ribs 54. In this manner, the initial height of the surface of the flexible circuit 11 on which the fusible conductive elements 15 are disposed is set.

Subsequently, ultrasonic welding is performed on the posts 53. During the ultrasonic welding, the posts 53 and the standoff ribs 54 are simultaneously welded so as to fix the flexible circuit 11 between the standoff ribs 54 and a deformed distal end 53' of each of the posts 53. The height of the surface of the flexible circuit 11 on which the fusible conductive elements 15 are disposed is precisely set and controlled by the ultrasonic welding process. Particularly, during the ultrasonic welding process, the height of the standoff ribs 54 is adjusted to precisely set and control the height of the surface of the flexible circuit 11 on which the fusible conductive elements 15 are disposed.

The thicknesses of each of the flexible circuit 11 and the stiffener 13 are often inconsistent. With the process described above, the height of the surface of the flexible circuit 11 on which the fusible conductive elements 15 are disposed can be precisely set and controlled regardless of the inconsistencies in the thicknesses of the flexible circuit 11 and the stiffener 13.

The height of the fusible conductive elements 15 disposed on the second end portion of the flexible circuit 11 is preferably set to be substantially flush to about 0.003 inches below the surface of the standoffs 52.

The array connector 22 is preferably attached to the flexible circuit 11 by a solder joint between solder balls corresponding to the array connector 22 and conductive pads provided on the first surface at the first end portion of the flexible circuit 11.

The electrical connector 22 can also be attached to the flexible circuit 11 by other connector attachment methods such as other welding methods, compression fits, press fits, or soldered thru hole.

Once the connector assembly 10 is assembled, the connector assembly 10 is connected to a printed circuit board (not shown) in a surface-mount manner, and the connector assembly 10 undergoes a reflow process in order to melt the fusible conductive elements 15 to electrically connect conductive pads of the flexible circuit 11 to corresponding conductive pads of the printed circuit board.

The present invention is not limited to the preferred embodiments described above. Many alternative preferred embodiments are possible.

It should be understood that the foregoing description is only illustrative of the present invention. Various alternatives and modifications can be devised by those skilled in the art without departing from the present invention. Accordingly, the present invention is intended to embrace all such alternatives, modifications and variations which fall within the scope of the appended claims.

What is claimed is:

1. An electrical connector assembly for providing an electrical connection to a circuit board, comprising:

a connector frame including a plurality of posts, each of the plurality of posts including at least one standoff rib extending therefrom;

a flexible circuit having a first end portion and a second end portion, the second end portion being arranged to be connected to a circuit board; wherein the flexible circuit includes a plurality of holes arranged to correspond to the plurality of posts;

each of the plurality of posts is received in a respective one of the plurality of holes; and a height of a first major surface of the second end portion of the flexible circuit above a circuit board is set by the at least one standoff rib of each of the plurality of posts.

2. The electrical connector assembly according to claim 1, further comprising:

a stiffener attached to a second major surface of the second end portion of the flexible circuit; wherein the height of the first major surface of the second end portion of the flexible circuit above a circuit board is set by engagement of the stiffener with the at least one standoff rib of each of the plurality of posts.

3. The electrical connector assembly according to claim 1, further comprising:

an array connector attached to the first major surface of the first end portion of the flexible circuit; wherein the array connector is received in a recess of the connector frame.

4. The electrical connector assembly according to claim 3, wherein the first end portion of the flexible circuit is arranged in a plane that is substantially perpendicular to a plane in which the second end portion is arranged.

5. The electrical connector assembly according to claim 3, wherein a stiffener is provided on the second major surface of the first end portion of the flexible circuit.

6. The electrical connector assembly according to claim 1, wherein the connector frame includes at least one fastener arranged to attach the connector frame to a circuit board.

7. The electrical connector assembly according to claim 1, wherein a plurality of fusible conductive elements are disposed on the first major surface of the second end portion of the flexible circuit that are arranged to be connected to corresponding conductive pads on a circuit board.

8. The electrical connector assembly according to claim 7, wherein the connector frame includes at least one standoff disposed along an edge of the recess, each of the at least one standoff having a surface extending in a plane that is substantially parallel to a plane of the first major surface of the second end portion of the flexible circuit, and a height of the plurality of fusible conductive elements is set to be substantially flush with to about 0.003 inches below the surface of each of the at least one standoff.

9. The electrical connector assembly according to claim 7, wherein the plurality of fusible conductive elements are solder balls.

10. The electrical connector assembly according to claim 1, wherein the connector frame includes at least one alignment pin arranged to engage a corresponding alignment structure on a circuit board.

11. The electrical connector assembly according to claim 1, wherein the flexible circuit is a flexible printed circuit.

12. The electrical connector assembly according to claim 1, wherein the electrical connector assembly is a right angle connector assembly.

13. A method of assembling an electrical connector assembly comprising the steps of:

providing a connector frame having a recess, a plurality of posts disposed in the recess, and at least one standoff rib extending from each of the plurality of posts, each of the plurality of posts having a distal end;

providing a flexible circuit having first and second major surfaces, first and second end portions, and a plurality of holes disposed in the second end portion;

arranging the second end portion of the flexible circuit on the connector frame such that each of the plurality of posts is received in a respective one of the plurality of holes, and a height of the first major surface of second end portion of the flexible member is set by the at least one standoff rib; and ultrasonic welding the plurality of posts and the at least one rib thereon so as to deform the distal end of each of the plurality of posts in order to fix the second end portion of the flexible circuit between the deformed distal end and the at least one rib; wherein during the step of ultrasonic welding, the at least one rib is deform so as to adjust the height of the first major surface of the second end portion of the flexible member to a desired height.

14. The method according to claim 13, further comprising the step of:

attaching a stiffener to the second major surface of the second end portion of the flexible circuit; wherein in the step of arranging the second end portion flexible circuit, the stiffener is disposed between the second end portion of the flexible circuit and the at least one rib; and a major surface of the stiffener is in contact with the at least one rib.

15. The method according to claim 13, further comprising the steps of:

providing another recess in the connector frame;

providing a groove at each of opposed ends of the another recess;

attaching an array connector to the first major surface of the first end portion of the flexible circuit, the array connector including a projection at each of opposed end portions thereof; and arranging the projections of the array connector in the grooves of the connector frame.

16. The method according to claim 15, wherein the groove at one opposed end of the recess has a width that is different from a width of the groove at the other opposed end of the recess, the projection at one opposed end of the array connector has a width that corresponds to the groove at the one opposed end of the recess, and the projection at the other opposed end of the array connector has a width that corresponds to the groove at the other opposed end portion of the recess, such that the array connector can be arranged on the connector frame in only one orientation.

17. The method according to claim 13, further comprising the steps of:

providing at least one standoff arranged along an edge of the recess of the connector frame, each of the at least one standoff having a surface extending in a plane that is substantially parallel to a plane of the first major surface of the second end portion of the flexible circuit; and providing a plurality of fusible conductive elements on the first major surface of the second end portion of the flexible circuit; wherein during the step of ultrasonic welding, the height of the flexible circuit is set such that the fusible conductive elements are set to a height that is flush with to about 0.003 inches below the surface of the at least one standoff extending in the plane that is substantially parallel to the plane of the first major surface of the end portion of the flexible circuit.

* * * * *